US006719164B2

(12) United States Patent
Maschio

(10) Patent No.: US 6,719,164 B2
(45) Date of Patent: Apr. 13, 2004

(54) PALLET CONTAINER FOR LIQUIDS

(75) Inventor: Pietro Maschio, Grezzago (IT)

(73) Assignee: Mamor S.p.A., Grezzago (IT)

( * ) Notice: Subject to any disclaimer, the term of this patent is extended or adjusted under 35 U.S.C. 154(b) by 260 days.

(21) Appl. No.: 10/071,683

(22) Filed: Feb. 8, 2002

(65) Prior Publication Data

US 2002/0112979 A1 Aug. 22, 2002

(30) Foreign Application Priority Data

Feb. 20, 2001 (IT) ..... MI2001A0343

(51) Int. Cl.[7] ..... B61D 21/00; B65D 1/34

(52) U.S. Cl. ..... 220/571; 220/9.4; 220/601; 220/DIG. 6; 206/386

(58) Field of Search ..... 220/571, 9.4, 601, 220/DIG. 6; 206/386

(56) References Cited

U.S. PATENT DOCUMENTS 4,527,707 A * 7/1985 Heymann et al. ..... 220/571
4,930,632 A * 6/1990 Eckert et al. ..... 206/386
5,249,699 A * 10/1993 Williams ..... 220/571
5,316,174 A * 5/1994 Schutz ..... 220/571
5,405,567 A 4/1995 Needham, et al.
5,429,236 A * 7/1995 Evans ..... 206/386
5,622,279 A 4/1997 Schutz
5,752,543 A * 5/1998 Groening ..... 137/312
6,029,583 A 2/2000 LeTrudet
6,050,437 A 4/2000 Schutz

FOREIGN PATENT DOCUMENTS

DE 94 07 343 9/1994
EP 0 629 785 12/1994

* cited by examiner

*Primary Examiner*—Joseph Man-Fu Moy
(74) *Attorney, Agent, or Firm*—Hedman & Costigan, P.C.

(57) ABSTRACT

A pallet container for liquids (10) comprises an inner plastic container (12), equipped with a filler (13) and a drain tap (14), both with a hermetic seal, protected by metal plating (16) and resting on a pallet (15), suitable to be moved with lifting means, and composed of a stamped metal plate tray (17), provided with stiffening grooves (22) and bearing elements, corner feet (18), central spacers (19, 19') and a drainer (20), made of plastic, and equipped with complementary engaging elements, for connection with a base ring (24) and with the tray (17).

12 Claims, 7 Drawing Sheets

PALLET CONTAINER FOR LIQUIDS

The present invention relations to a pallet container for liquids which can be used to store, move and transport liquids, even of a corrosive nature.

These pallet containers are composed of an inner plastic container, equipped with a filler and a drain tap, both with a hermetic seal, resting on a metal pallet and protected by a metal sheath produced in the form of a cage or plate.

The pallet to be moved by lifting means is composed of a stamped metal plate tray and a plurality of corner and central feet, welded or screwed to a base ring and to the tray, which distance the inner container from the ground, to allow the lifting means to operate.

An alternative proposed in the past, but which did not have great success due to the extremely high loads to which the tray was subjected, proposed production of the pallet in a single piece in stamped plastic material.

The bottom of the inner plastic container and the metal tray is equipped with a drainage channel, which extends sloping downwardly from the rear wall to the front wall to convey the liquid towards the tap.

The central foot is appropriately shaped corresponding to the tap in order not to hinder access to the tap during draining operations.

To improve the load capacity, a reinforcing plate may be fitted under the tray, positioned transversally in relation to the drainage channel. A similar function is performed by the stiffening grooves stamped on the bottom of the tray.

Alternatively to being fixed with screws or welded, the shaped central foot and the central feet in the vicinity of the reinforcing plate are frequently cast integrally to the tray and reinforcing plate respectively.

The main problems concern operations to cast the metal plate to obtain pieces with a transversal section provided with a considerable difference in height. The tray comprising the shaped central foot and the transversal reinforcing plate, from which two side feet are shaped, are pieces that require several subsequent casting operations. The dies required for these operations must take account with extreme precision of the shrinkage of the metal plate. Therefore, the design and production of dies are just as costly as the operations to cast the pieces.

If the metal plate casting operations are not performed optimally, this would cause considerable reduction in the resistance of the pallet to static and dynamic stresses. During transportation the pallet is subjected to bending fatigue stress, caused by oscillation of the masses of liquids transported and drive oscillations transmitted by the vehicle.

Moreover, the pallet containers for liquids, especially if used to transport corrosive liquids, must be dismantled and recycled at the end of their period of use. In fact, for example, the shaped central foot positioned corresponding to the drain tap is greatly subjected to corrosion.

The pallet containers described require laborious dismantling operations to unscrew or separate the weld points and proceed with the recycling of the metal.

The object of the present invention is to produce a pallet container for liquids that attains an excellent level of stability and resistance to applied loads, which influences the safety of transport.

Another object of the present invention is to produce a pallet container for liquids produced with a simple production and recycling cycle.

Yet another object of the present invention is to produce a particularly simple and functional pallet container for liquids with reduced costs.

These objects according to the invention are attained by producing a pallet container for liquids as set forth in claim 1.

Further characteristics are provided for in the subordinate claims.

The characteristics and advantages of a pallet container for liquids according to the present invention shall become more evident from the following description, provided as a non-limiting example, referring to the schematic drawings attached in which.

Figure 3:
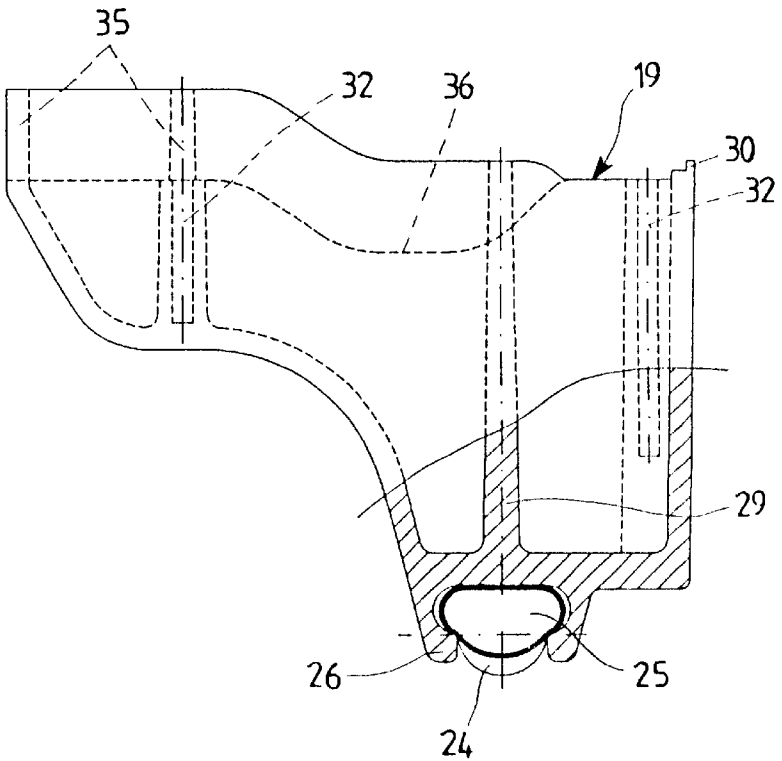
FIGS. 2 and 3 are a plan view and a partly sectional elevation of a first embodiment of a spacer of the pallet container in FIG. 1.
Figure 2:
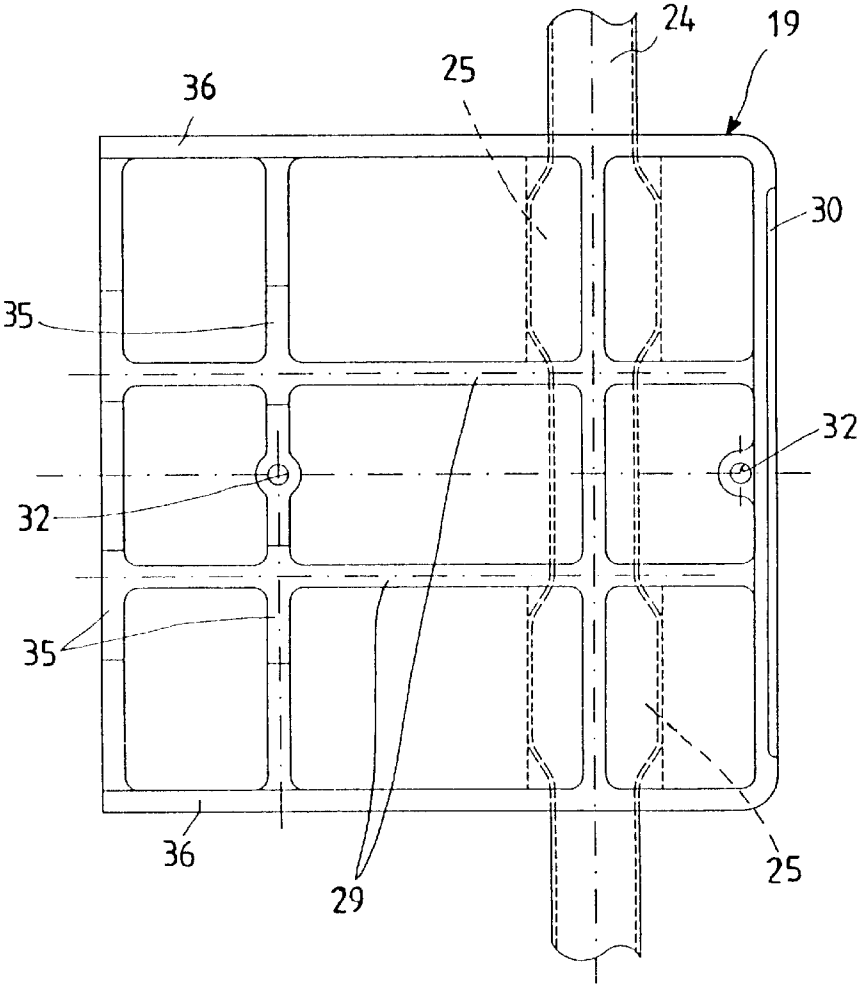
Figure 3A:
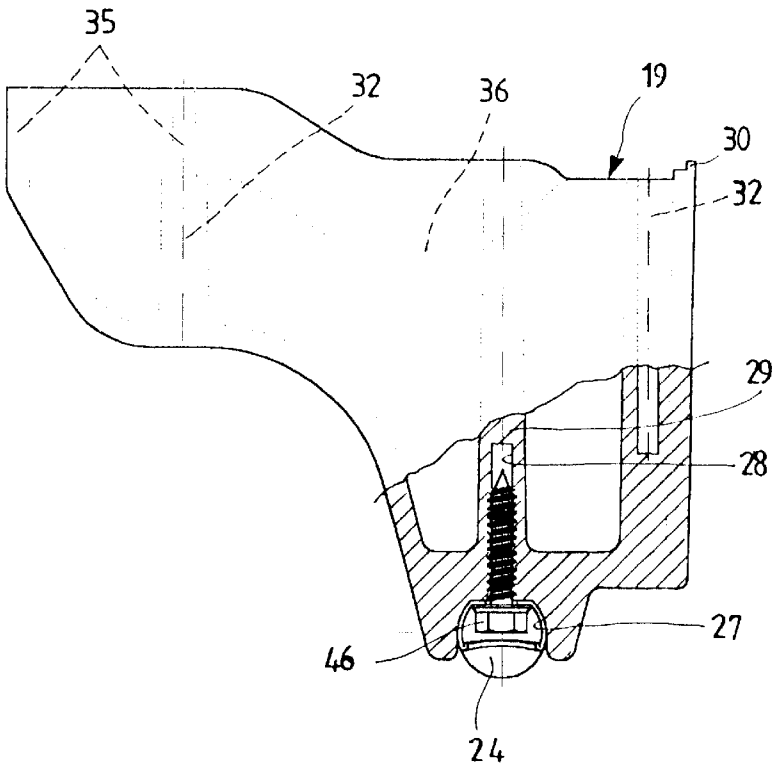
Figure 2A:
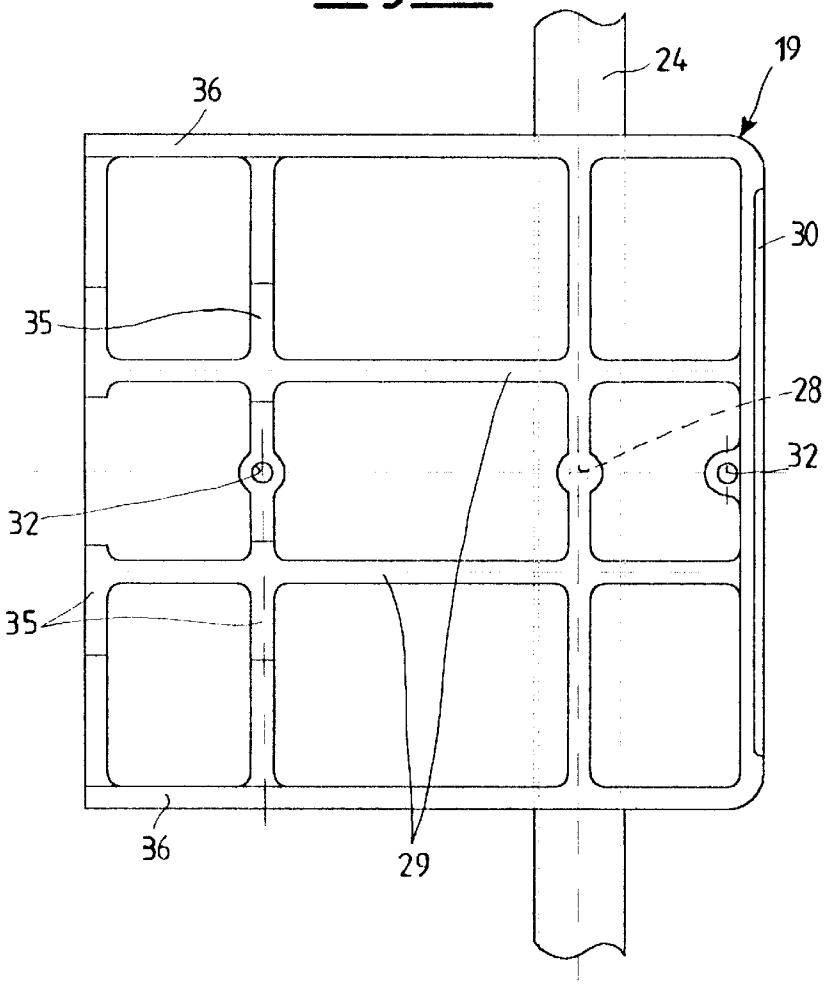
Figure 5:
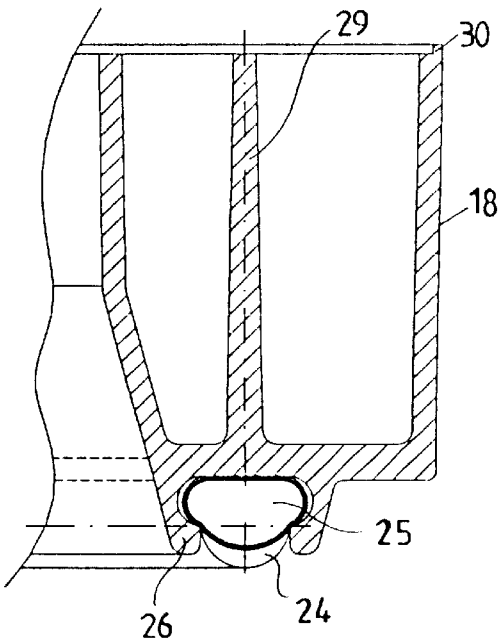
Figure 4:
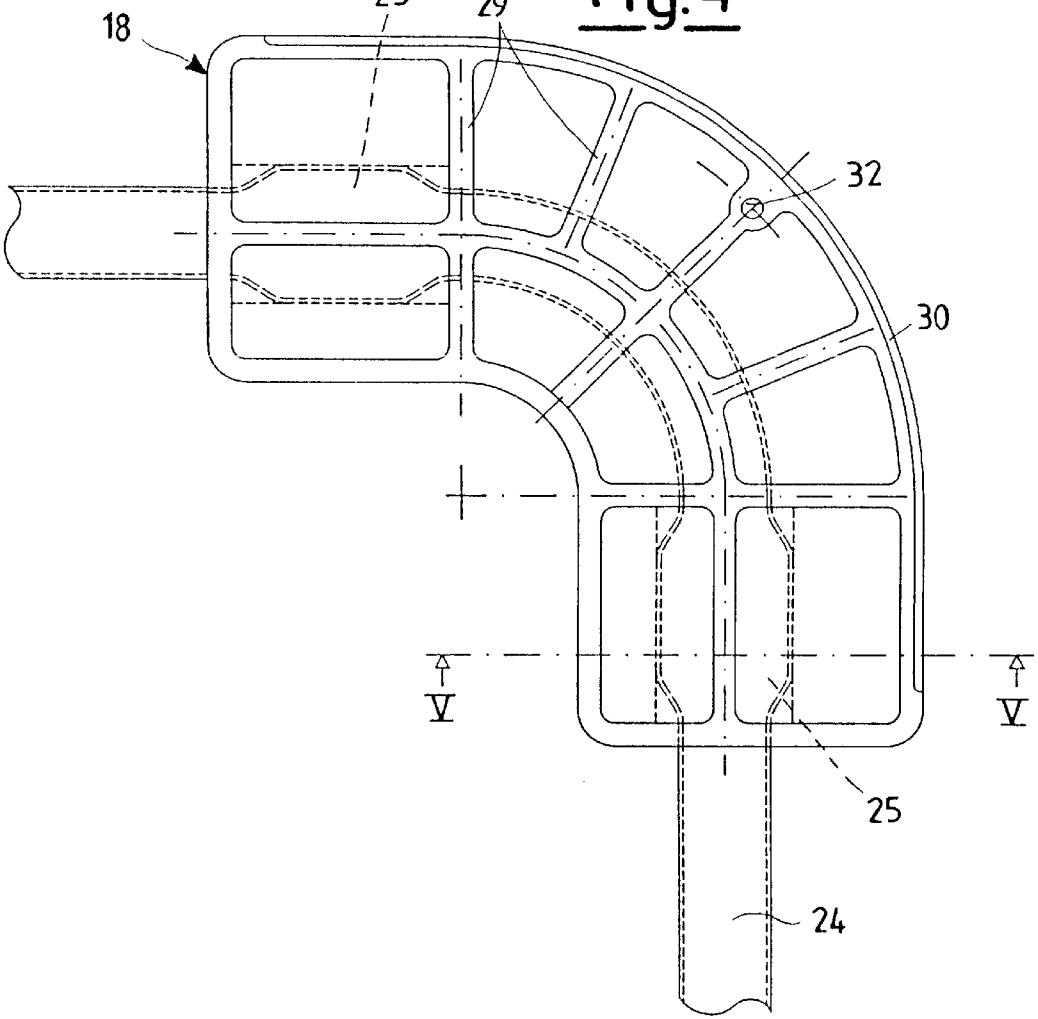
Figure 5A:
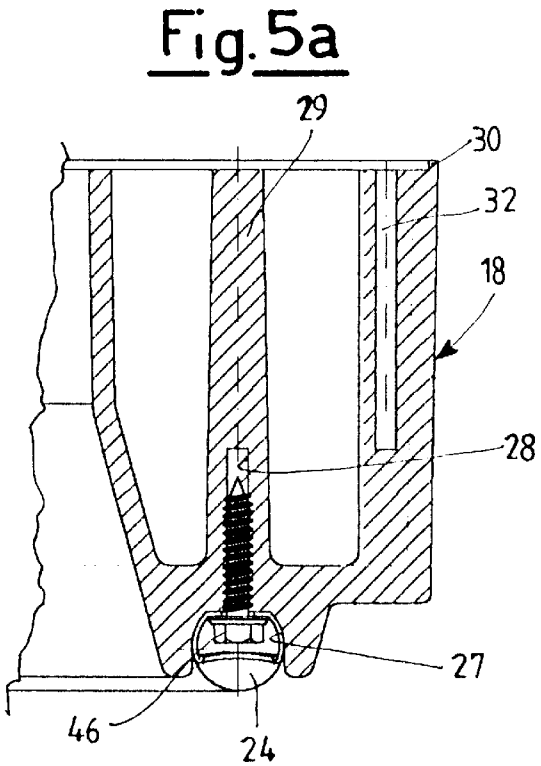
Figure 4A:
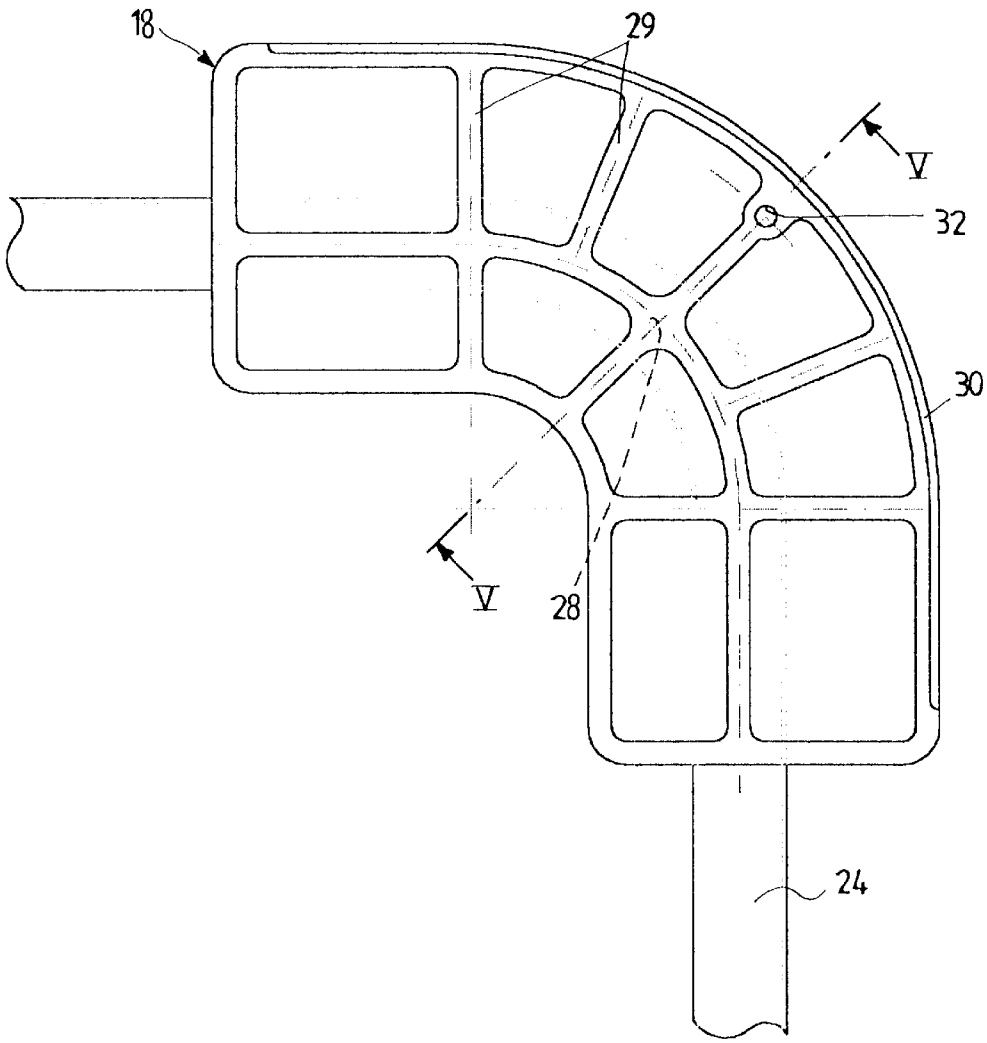
Figure 7:
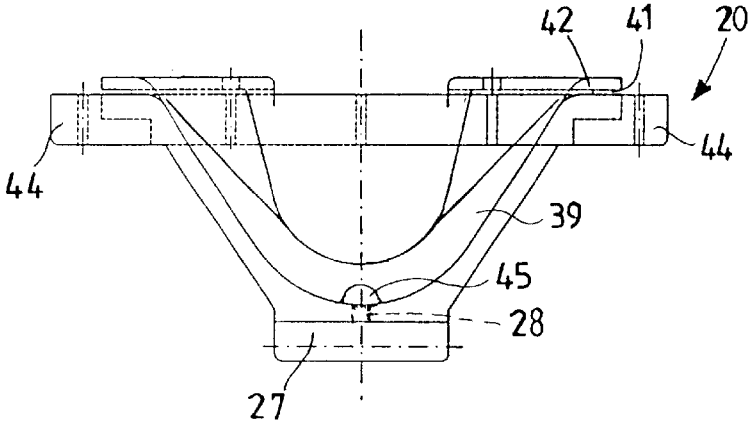
Figure 6:
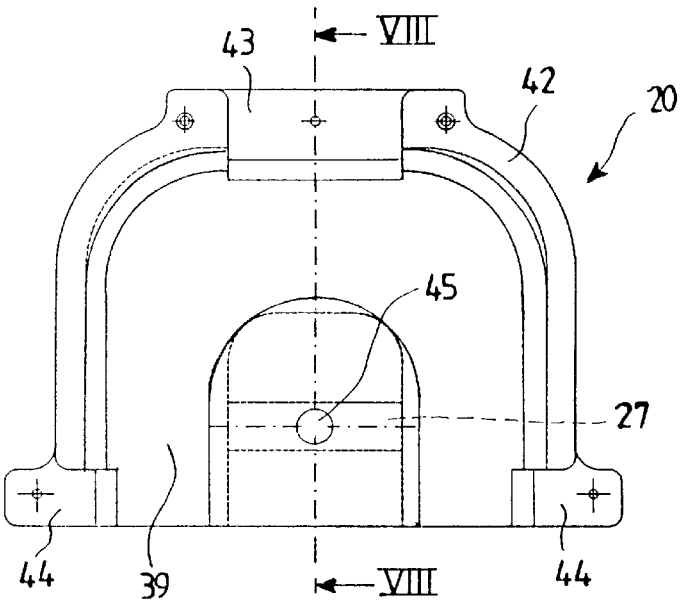
Figure 8:
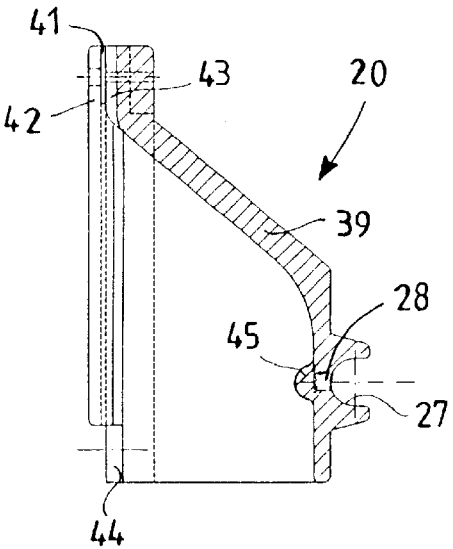
Figure 9:
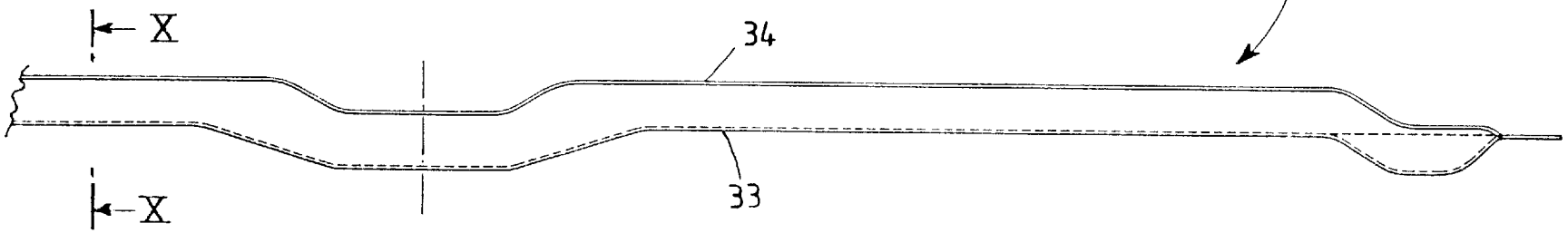
Figure 10:
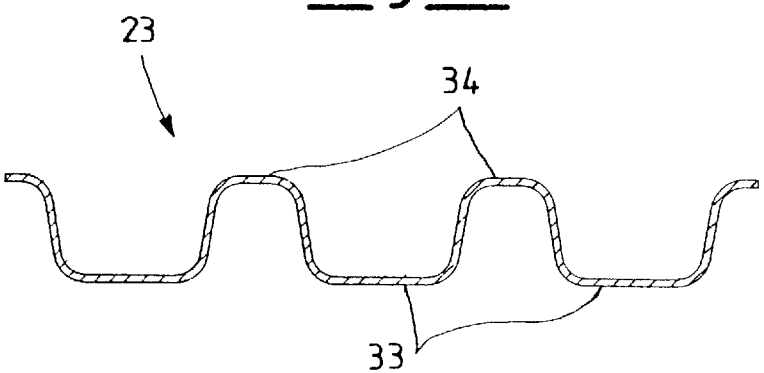

FIGS. 2*a* and 3*a* are a plan view and a partly sectional elevation of a second simplified embodiment of a spacer;

FIGS. 4 and 5 are a plan view and a sectional side elevation according to the line V—V of a corner foot of the pallet container according to the present invention;

FIGS. 4*a* and 5*a* are a plan view and a sectional side elevation according to the line V—V of a second simplified embodiment of a corner foot;

FIG. 6 is a plan view of a drainer of the pallet container of the present invention;

FIG. 7 is a front elevation view of the drainer in FIG. 6;

FIG. 8 is a sectional side elevation view of the drainer in FIG. 6 according to the line VIII—VIII;

FIG. 9 is a partial side elevation view of a reinforcing crossbar;

FIG. 10 shows the crossbar in FIG. 9 sectionally according to the line X—X.

Figure 1:
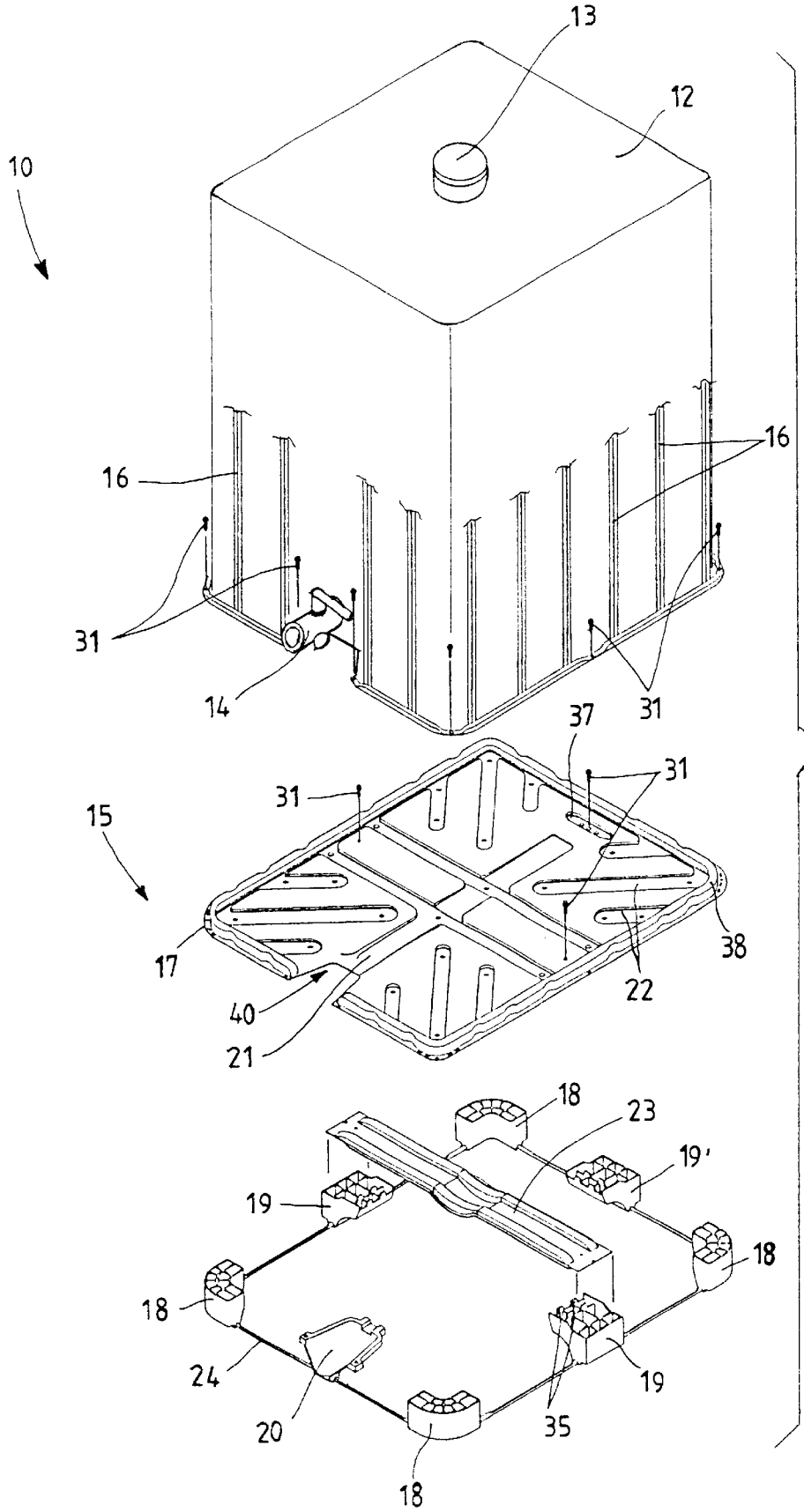
FIG. 1 is an exploded view of a pallet container according to the present invention.

With reference to the figures, these show a pallet container for liquids, indicated as a whole with 10, comprising an inner plastic container 12, provided with a filler 13 and a drain tap 14, both with a hermetic seal, resting on a pallet 15 and protected by a metal coating, embodied in this example in the form of a cage 16 (FIG. 1).

The pallet 15 must be suitable to be moved by lifting means and is composed of a stamped metal plate tray 17 and bearing elements. These bearing elements made of plastic consist of four corner feet 18, three central spacers 19 and 19' and one drainer 20, positioned corresponding to the tap 14 and suitably shaped so as not to hinder access to said tap 14 during draining operations. The example proposes moulding of high density polyethylene (PE HD), a recyclable plastic with good resistance.

The bottom of the inner plastic container 12 and the metal tray 17 are equipped with a complementary drainage channel 21, which extends sloping from the rear wall to the front wall to convey the liquid towards the tap 14.

In addition to said drainage channel 21 the tray 17 is stamped with stiffening grooves 22, the bottoms of which lie on generic horizontal surfaces.

A crossbar 23 made of metal plate is applied under the tray 17 perpendicular to the direction of the drainage channel 21, interposed between the spacers 19 and said tray 17.

The corner feet 18, the spacers 19 and 19' and the drainer 20, made of moulded plastic, are provided with complementary engaging elements for connection with said tray 17 and with a base ring 24.

The base ring 24 is generally composed of a metal tube, arranged around the perimeter of the pallet 15, and in the example shown in FIGS. 2–5, it has deformed portions 25, flattened, corresponding to the corner feet 18 and the spacers 19 and 19'. Connection is obtained by using pressure to clip on gripping means 26 positioned on the lower side of the bearing elements 18, 19 and 19', on the deformed portions 25 of the base ring 24.

In a simplified embodiment compared with the one in which pressure is used to clip on, the bearing elements, corner feet 18, spacers 19 and 19' and the drainer 20 are provided with a seat 27, shaped to guarantee shaped connection with the tubular base ring 24 and bearing a blind hole 28, accessible from said seat 27.

Through the base ring 24 a screw 46 engages from the outside in said hole 28 to provide a restraint to vertical detachment of each component, guaranteeing permanent contact between the bearing surfaces (FIGS. 2*a*–5*a*, 6–8).

The drainer is equipped, corresponding to said seat 27, with a thickening of a wall 39 in the form of a boss 45, in which said hole 28 is produced.

The wall 39 of the drainer 20, which comes into contact with any corrosive liquids transported in the pallet container 10, is therefore entirely produced in plastic and protects the metal base ring 24 from phenomena of corrosion.

The corner feet 18 and central spacers 19 and 19', moulded in high density polyethylene, are hollow elements provided with ribbing 29, distributed to withstand stresses better. Moreover, the corner feet 18 and, to an even greater extent, the spacers 19 and 19' have a tapered profile to convey stresses to the base ring 24. Distribution of the ribbing 29, the cavities and also the external shape of the bearing elements, indicated in the figures, are an example, which may be replaced with equivalent embodiments.

The corner feet 18 and spacers 19 and 19' have a restricting collar 30, produced along the perimeter, which forms the engaging element for shaped connection with said tray 17. One or more screws 31 for fixing the cage 16, tray 17 and corner feet 18, or in the case of the spacers 19 also the crossbar 23, engage in holes 32 produced in the ribbing 29.

The dual restraint between the tray 17 and bearing elements 18, 19, 19' and 20, consisting of the shaped connection, combined with one or more screws 31 prevent rotation of the feet 18 and the spacers 19 and 19' when these are knocked against accidentally by the lifting means.

The spacers are fitted to the base ring, as described above, the spacers 19 corresponding to the crossbar 23 and the spacer 19' on the rear side of the pallet container 10.

The crossbar 23, underneath the tray 17, is also positioned resting against the restricting collar 30 of the spacers 19 to which it is connected by screws 31. The section of the crossbar 23, characterized by grooves 33 and raised portions 34 (FIGS. 9 and 10), can be advantageously employed to produce a restraint with complementary shapes 35 of said spacers 19, which for example extend from the ribbing 29. Positioning of the crossbar 23 on the spacers 19 can also be determined by two restricting side walls 36 (FIGS. 2 and 3).

The spacer 19' fitted corresponding to the rear wall of the container 10 is instead connected directly to the tray 17 by one or more screws 31 and possibly even through a restraint with engaging elements 37 provided on said tray 17 (FIG. 1).

Similarly to what has already been explained, it would be possible to provide shaped connection also between the ribbings 29 of the corner feet 18 and a raised perimeter 38 of the tray 17.

The drainer 20, moulded in plastic resistant to corrosion, in the example PE HD, has the shape of a chute, in which the wall 39 is tilted towards the centre and forwardly (FIGS. 6–8). At the top it is attached to the tray 17, which has a notch 40, reproducing the shape and dimensions of the drainer 20.

The tray fits into a perimetric groove 41 produced on a top rim 42, which forms the engaging element to fit the tray 17 between the two layers of plastic of the drainer 20.

The rear portion of the drainer 20 is shaped with a groove 43 resting on which is the end portion of the drainage channel 21 of the tray 17.

In the front zone the tray 17 rests on two edges 44 of the top rim 42 of said drainer 20 to which it is connected with the screws 31.

The pallet container for liquids according to the present invention has the advantage of having a pallet composed of metal plate parts with a simple shape, the production cycle of which is fast and guarantees attainment of an excellent level of resistance. Owing to the essentially flat shape of the pieces, casting operations are in fact performed in one single phase.

Connections between each part, made by interlocking complementary shapes, guarantee excellent restraint to relative rotation of individual parts which are at the same time easily disassembled.

The use of plastic, in the example high density polyethylene, has the advantage of eliminating corrosion of the drainer, which collects drops of liquid during draining operations. The use of components made of plastic facilitates operations to recycle the pallet container.

What is claimed is:

1. Pallet container for liquids comprising an inner plastic container (12), equipped with a filler (13) and a drainage tap (14), both with a hermetic seal, protected by a metal coating (16) and resting on a pallet (15), suitable to be moved by lifting means and composed of a stamped metal plate tray (17), provided with stiffening grooves (22) and bearing elements, corner feet (18), central spacers (19, 19') and a drainer (20), connected to a base ring (24), where the bottom of the inner container (12) and the metal tray (17) are equipped with a complementary drainage channel (21), which extends sloping downwardly from the rear wall to the front wall, and perpendicular to the drainage channel (21) fitted with a crossbar (23) in metal plate, characterized in that said bearing elements (18, 19, 19', 20) are made of plastic and are equipped with complementary engaging elements for connection with said base ring (24) and with said tray (17).

2. Pallet container for liquids as claimed in claim 1, characterized in that said complementary engaging elements for connection between said bearing elements (18, 19, 19', 20) and said base ring (24) consist of gripping means (26), that clip with pressure onto deformed portions (25) of said base ring (24).

3. Pallet container for liquids as claimed in claim 1, characterized in that said complementary engaging elements for connection between said bearing elements (18, 19, 19', 20) and said base ring (24) consist of a seat (27) shaped to house with shaped connection said base ring (24), equipped with a hole (28) for externally engaging a screw (46), which provides a restraint to vertical detachment.

4. Pallet container for liquids as claimed in claim 1, characterized in that said complementary engaging elements for connection between said bearing elements (18, 19, 19', 20) and said tray (17) consist in a restricting collar (30) obtained along the perimeter to receive with shaped connection the tray (17) and the crossbar (23), connected by one or more screws (31) to said bearing elements (18, 19, 19', 20).

5. Pallet container for liquids as claimed in claim 1, characterized in that said complementary engaging elements for connection between said bearing elements (18, 19, 19', 20) and said tray (17) consist in a perimetric groove (41), produced on an upper rim (42) of the drainer (20).

6. Pallet container for liquids as claimed in claim 1, characterized in that said corner feet (18) and spacers (19,

19') are hollow elements provided with ribbings (29), on which screws (31) act as a restraint to vertical detachment of the metal coating (16), tray (17) and crossbar (23).

7. Pallet container for liquids as claimed in claim 1, characterized in that said drainer (20) is composed of a wall (39) tilting towards the centre and forwardly.

8. Pallet container for liquids as claimed in claim 3, characterized in that said hole (28) is blind and produced in the thickening of a wall (39) of said drainer (20) in the form of a boss (45).

9. Pallet container for liquids as claimed in claim 1, characterized in that said bearing elements (18, 19, 19' 20) are produced in high density recycled polyethylene.

10. Pallet container for liquids as claimed in claim 1, characterized in that said crossbar (23) has a section with grooves (33) and raised portions (34) that produce a restraint with complementary shapes (35) of said spacers (19).

11. Pallet container for liquids as claimed in claim 1, characterized in that said tray (17) is provided with engaging elements to engage with the central spacer (19') positioned on the rear wall.

12. Pallet container for liquids as claimed in claim 1, characterized in that the rear portion of said drainer (20) has a groove (43) resting on which is the end portion of the drainage channel (21) of the tray (17).

* * * * *